US005639078A

United States Patent [19]

Mandel et al.

[11] Patent Number: 5,639,078

[45] Date of Patent: Jun. 17, 1997

[54] AUTOMATIC SHEET STACKING EDGE REGISTRATION MEMBERS REPOSITIONING SYSTEM WITH TRANSVERSE TAMPER POSITIONING

[75] Inventors: Barry P. Mandel, Fairport; Joseph J. Ferrara, Webster; Frederick A. Green, Fairport, all of N.Y.

[73] Assignee: Xerox Corporation, Stamford, Conn.

[21] Appl. No.: 566,199

[22] Filed: Dec. 1, 1995

[51] Int. Cl.[6] ..... B65H 39/02

[52] U.S. Cl. ..... 270/58.12; 270/58.17; 270/58.27; 271/223

[58] Field of Search ..... 270/58.01, 58.07, 270/58.11, 58.12, 58.16, 58.17, 58.27; 271/223

[56] References Cited

U.S. PATENT DOCUMENTS

| | | | |
|---|---|---|---|
| 4,993,697 | 2/1991 | Yamashita et al. | 270/58.17 |
| 5,044,625 | 9/1991 | Reid | 270/58.16 X |
| 5,188,353 | 2/1993 | Parks | 271/184 |
| 5,398,918 | 3/1995 | Rizzolo et al. | 270/53 |
| 5,443,249 | 8/1995 | Rizzolo et al. | 270/53 |
| 5,473,420 | 12/1995 | Rizzolo et al. | 271/223 X |
| 5,537,195 | 7/1996 | Sagara et al. | 271/223 X |

*Primary Examiner*—Hoang Nguyen

[57] ABSTRACT

In a sheet compiling and fastening system, in which a plurality of printed sheets may be stacked in a compiler with their opposing lateral edges being tamped with opposing edge tampers repositionable to different sheet dimensions, dual U shaped binding edge registration members are respectively connected to these dual edge tampers, laterally offset, so as to automatically reposition therewith for optimized registering of a binding edge of the sheets which is orthogonal to the tamped sheet edges. A single stapler is movable parallel to this binding registration edge for selectably plurally stapling the stacked sheets, and the edge registration members are dimensioned to be movable by the edge tamper movement system directly through the open jaw of the stapler to avoid interference and provide a more compact system.

6 Claims, 4 Drawing Sheets

AUTOMATIC SHEET STACKING EDGE REGISTRATION MEMBERS REPOSITIONING SYSTEM WITH TRANSVERSE TAMPER POSITIONING

Disclosed is an improved system for repositionable sheet stacking edge registration members allowing non-interfering binding options for that edge, automatically repositioned by the orthogonal edge tamping system.

Of particular background interest is Xerox Corporation U.S. Pat. No. 5,398,918 (D/92331C) issued Mar. 21, 1995 to the same Barry P. Mandel and Joseph J. Ferrara and five others, which is a continuation of an application originally filed Jan. 25, 1993. This patent illustrates in detail a sheet stacking compiler/finisher system with a variable position stapler capable of putting one or more staples in various positions along one edge of a set of sheets being compiled in a compiler, in which a pair of U-shaped edge registration members such as 100 and 102 are fastened directly or via springs to the sides of the movable stapler head, so that these edge registration members are always kept out of the way of the stapler and therefore do not interfere with the stapler movement or stapling. This 5,398,918 patent also illustrates and describes a separate, unconnected edge tamper system for laterally tamping opposing edges of the sheets which are orthogonal the stack edge being stapled. Additional disclosures of movable edge registration systems connected to move with the stapler mechanism are in Xerox Corporation U.S. Pat. No. 5,443,249, issued Aug. 22, 1995, to the same Charles D. Rizzolo, et al (D/92331i).

Additional references and examples of linerally movable staplers capable of stapling either one corner of the set or two or three selected staple positions along one edge of the set, are additionally disclosed in additional references. (The prior art also includes fixed registration backstop systems and plural staplers as well.)

Further details of an exemplary set stacking tamper system in a compiler/finisher are also disclosed in commonly assigned Xerox Corporation pending U.S. application Ser. No. 08/311,622, filed Sep. 23, 1994 by Frederick A. Green (D/94126), entitled "Dual Mode Set Stacking Tamper and Sheet Feeder Offset System" (and art cited therein) now U.S. Pat. No. 5,513,839 issued May 7, 1996 . There, the tamping system is disclosed as movable to an extreme, non-tamping, position to laterally shift output rollers for sheet offsetting.

Further by way of background, some other examples of patents relating to set edge tamping include U.S. Pat. Nos. 5,044,625; 5,288,062; 5,188,353; 5,044,625 (D/87242); 3,860,127; 4,134,672; 4,477,218; 4,480,825; 4,616,821; 4,925,172; 4,925,171 (D/87219); 5,098,074 (D/88157); and 5,044,625 (D/87242); and art cited therein. As noted in some of these tamping system patents, in in-bin sorter stapling systems, the tamper may also provide offsetting in the tamping direction into a side stapler.

Typically, and as taught in said art, an edge tamper system includes a spaced pair of upstanding sheet edge tampers between which printed sheets may be compiled, and a tamper drive system, with which at least one of the tampers is driven towards the other tamper until the stack edges can be engaged, and the edge tampers are reciprocated by the drive system to tamp the print job set into a squared stack in a defined stacking and tamping position in the compiler or stacking tray. As shown in the cited references, and the example herein, the tamper drive system can be, for example, a stepper motor or servo motor connected to a central pinion gear driving opposing gear racks connecting to the respective edge tampers. Before sheets are compiled, the spacing between the edge tampers may be set according to the dimension of the sheets to be stacked. This spacing setting may be equal to the paper dimension plus the desired tamper stroke dimension, e.g., approximately 18 mm per side. This preset spacing between tampers of a slightly greater dimension than the corresponding sheet dimension also allows the sheets to readily settle between the tampers during the compiling process.

Although the particular manner of ejecting a stapled set from a compiler after it has been stapled (into the adjacent tray or bin) is not necessary to the present disclosure, besides various descriptions thereof in the above-cited references, there are additional descriptions in Xerox Corporation allowed U.S. application Ser. No. 08/334,984, filed Nov. 11, 1994 (D/94063) and U.S. Pat. No. 5,342,034 issued Aug. 30, 1974 (D/92332Q), by the same Barry P. Mandel, et al.

The disclosed embodiment represents a substantial improvement in several respects over the above-cited patents and applications. Among the disclosed features and advantages is the providing of a simple, compact, and low cost system which has smaller overall or outside dimensions, yet provides optimized edge registration positions, and provides fully unobstructed movement of the stapler or other set fastening apparatus relative to the registration members which hold the compiled set of sheets in the staplet's binding edge registration position before and during stapling or other fastening.

Among other advantageous features disclosed in the embodiment hereinbelow are edge registration members which have a vertical height or overall thickness which is less than that of the jaw or throat dimension of the movable stapler in the stapler's open position, enabling a registration edge member to pass directly through the stapler throat (or the stapler to pass by the registration member) as the stapler is translated along the binding edge of the set. Unlike the above-cited U.S. Pat. No. 5,398,918 or U.S. Pat. No. 5,443,249, in the disclosed system the binding edge registration members are not attached to or moved by the stapler unit or the stapler movement system. Nor do the registration edge members here need to move out of the way as the stapler(s) translate.

In contrast, in the embodiment disclosed hereinbelow, the edge registration members providing the stack alignment along the stapling edge of the stack are moved by the tamping system, and move with the tampers, and in fact may be attached directly to the edge tampers, even though those edge tampers are also providing the orthogonal tamping of the sheets of the set being compiled. That is, the tampers are tamping different edges of the sheets which are perpendicular to the binding edge defined and controlled by the subject registration edge members. Yet, a desirable generally U-shaped and open mouth configuration of the binding edge registration members may still be provided in the present system (as in said U.S. Pat. No. 5,398,918).

Other advantages and features of the disclosed embodiment include the fact that only two binding edge registration members are required, yet they can provide optimal registration of a wide variety of sheet sizes because of their automatic movement with the tampers automatically adjusting these registration members to an optimum location.

To express this another way, since the registration edges in the disclosed system herein follow the motion of the tampers, and since the tampers adjust to the lateral dimensions of different size sheets which they are tamping automatically, the registration edges also automatically adjust their position for different paper sizes.

Furthermore, because no registration members are attached to the stapler, and no registration member needs to always be outside of the stapler, when the stapler is in its maximum or fully extended positions at either side of the unit nothing is required to protrude from the system out further than the stapler itself, since the registration member can move through the stapler throat to the inside thereof, or to the outside thereof, as the stapler is moved. This allows for a more compact overall system. To express it another way, the stapler can move past the registration member to staple either outside or inside of the registration edge member. The registration edge members can be maintained in their same desired configuration and facing and are not required to pivot or to change configuration.

As shown in the example hereinbelow, the relative position of the registration edge members to the tampers tamping edge guide position and the selected stapling positions may desirably be selected so that the stapler mechanism will not need to be actuated when a registration edge is in the throat, mouth or jaws of the stapler mechanism. Thus, the relative geometry can be such that for single, i.e., corner portrait or landscape stapling, the registration edges are not in the stapling position, irrespective of the size of the sheet. Likewise, their positioning may also allow triple stapling (staples in three positions spaced along the binding edge) without interference between the stapler and the registration edges. (See FIG. 3). Optionally, e.g., for dual stapling in the example here, the registration edges may be automatically moved out of the way of the staplers by a slight distance by automatically moving the tampers slightly away from the edges of the stack being tamped, to move out the registration edges correspondingly prior to the actuation of the stapler (see FIG. 4).

A specific feature of the specific embodiment disclosed herein is to provide a sheet compiling and fastening system having a compiler in which a plurality of printed sheets may be stacked, an edge tamper system for tamping opposing lateral edges of the sheets being stacked, wherein said edge tamper system is movable to adjust to different sheet dimensions of different sheets being stacked in said compiler, there is provided repositionable edge registration members connected to move with said edge tamper system for registering an edge of said sheets orthoginal to said tamped lateral edges along a binding registration edge, and a movable sheet set fastening system which is movable generally parallel to said binding registration edge for selectably fastening said stacked sheets in spaced fastening positions.

Further specific features provided by the system disclosed herein, individually or in combination, include those wherein there are two said edge registration members, and said edge tamper system comprises two opposing edge tampers, and each said edge registration member is connected independently to one of said edge tampers but is laterally offset therefrom; and/or wherein said edge registration members are movable by said edge tamper system through said movable sheet set fastening system; and/or wherein said sheet set fastening system comprises a linerally movable stapler with an open jaw having a defined opening, and wherein said edge registration members have a dimension smaller than said defined open jaw opening of said stapler and are movable through said open jaw opening of said stapler by movement of said edge tamper system; and/or wherein there are two said edge registration members, which are generally U-shaped, and said edge tamper system comprises two opposing edge tampers, and each said edge registration member is connected independently to one of said edge tampers but is laterally offset therefrom; and/or wherein said sheet set fastening system comprises a linerally movable stapler with an open jaw having a defined opening, and wherein said edge registration members have a dimension smaller than said defined open jaw opening of said stapler and are movable through said open jaw opening of said stapler by movement of said edge tamper system, and wherein there are two said edge registration members, and said edge tamper system comprises two opposing edge tampers, and each said edge registration member is connected independently to one of said edge tampers but is laterally offset therefrom.

It is well known and commonplace to program and execute imaging, printing and paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. Alternatively, the disclosed system or method may be implemented partially or fully in hardware, using standard logic circuits or a single chip using VLSI designs.

In the description herein the term "sheet" refers to a usually flimsy physical sheet of paper, plastic, or other suitable physical substrate for images, whether precut or web fed. A "job" is normally a set of related sheets, usually a collated copy set copied from a set of original document sheets or electronic document page images, from a particular user, or otherwise related.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of this embodiment thereof, including the drawing figures (approximately to scale) wherein:

Figure 1:
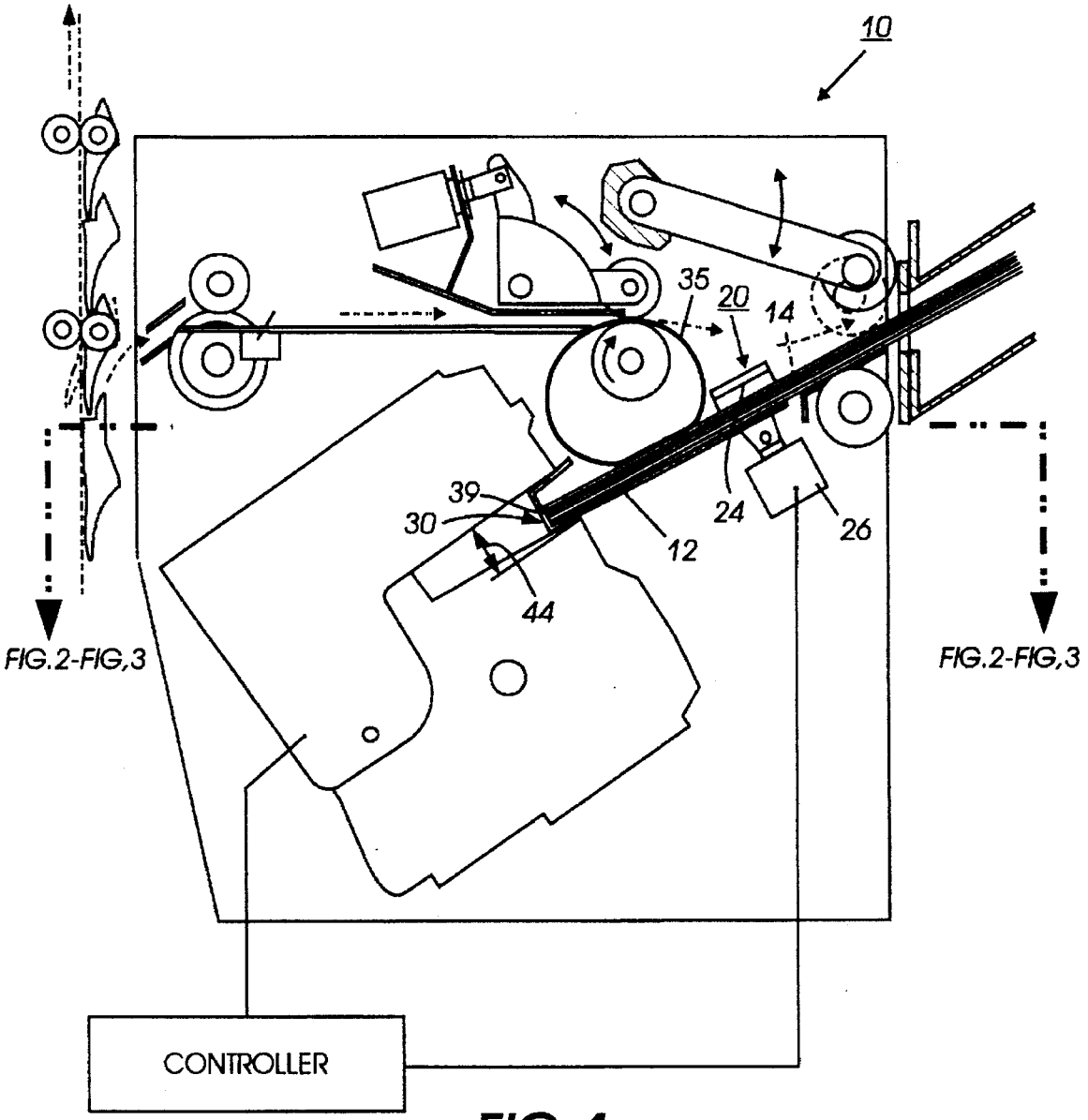
FIG. 1 is a schematic side view of one embodiment of the disclosed integral tamping and registration system shown in one example of a compilor/stapler system which is part of an exemplary print job mailboxing system.
Figure 5:
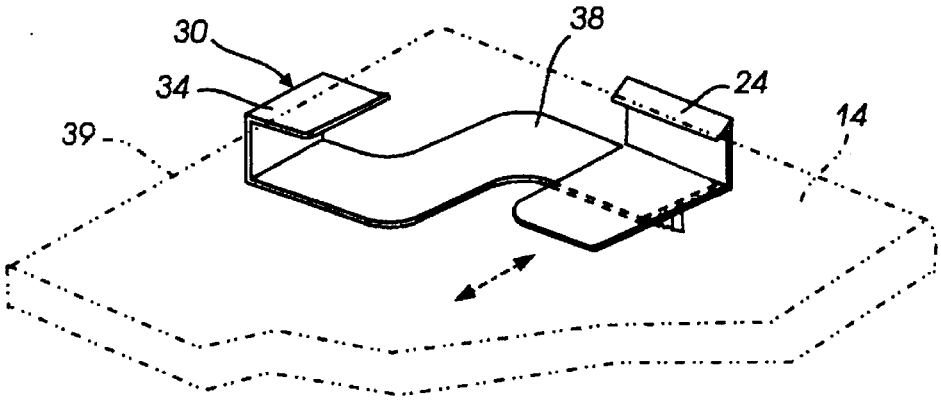
FIG. 5 is a perspective view of a single exemplary component of the disclosed exemplary system, namely one of the two disclosed integral edge tamper and registration member components.
Figure 2:
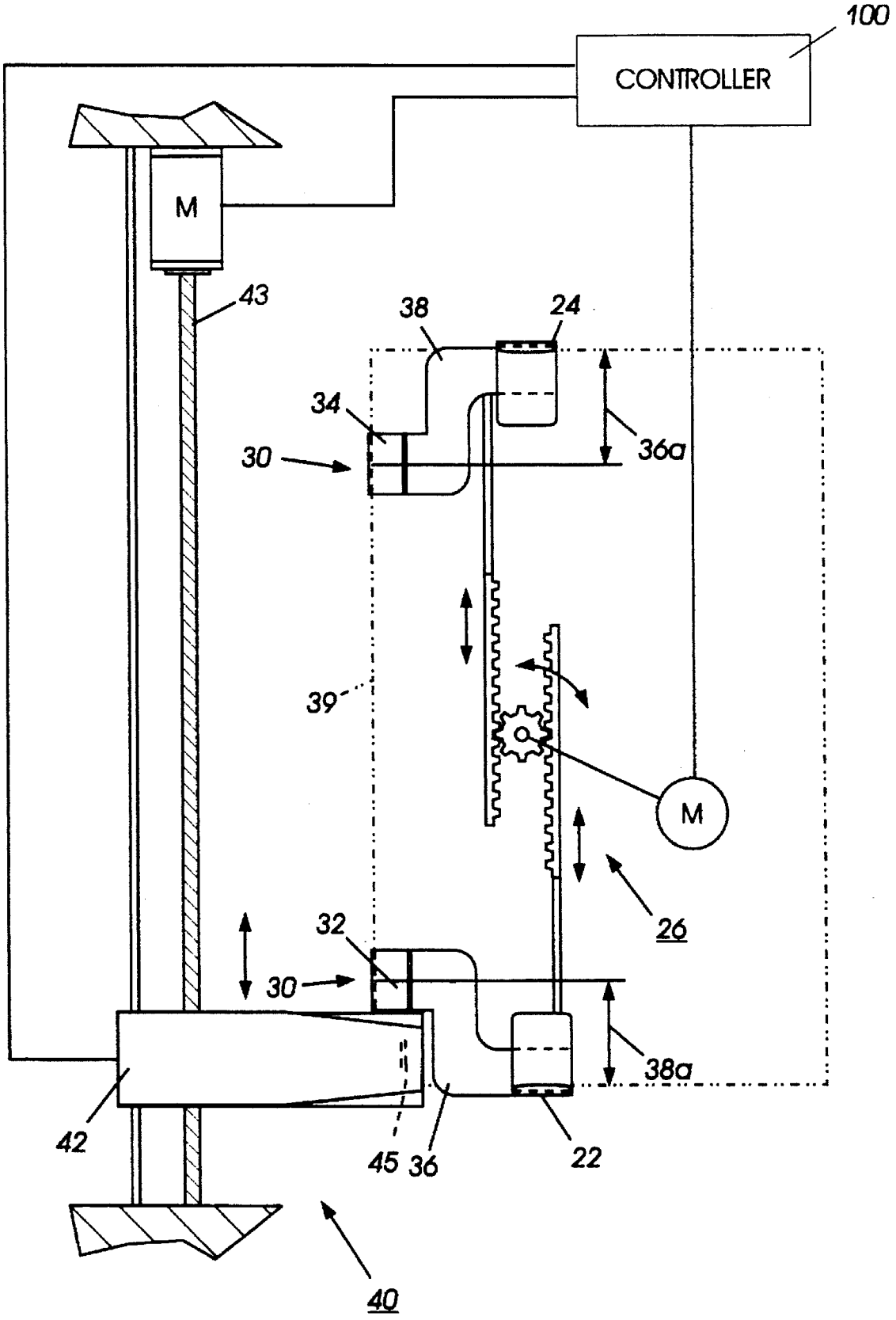
FIG. 2 is a top view of the system of FIG. 1 taken along the line FIG. 2–FIG. 3 of FIG. 1 showing corner stapling of a print job set stacked in the compilor.

Referring now to the exemplary embodiment illustrated in the figures, there is shown an exemplary sheet compiling and fastening system 10, in which sheets are compiled in a compiler tray 12. As described in the above-cited references, this may be an otherwise known partial compiler tray (as shown) in which sheets 14 are accumulated, squarely stacked with tamping, and then stapled and ejected. Those aspects of the system 10 which are already taught in the above cited and in other patents and applications need not be repeated herein. The following description will thus be with particular reference to the novel aspects of this disclosed system 10.

The system 10 includes what may be an otherwise conventional edge tamper system 12 with edge tampers 22 and 24 providing vertical edge tamping surfaces on opposite sides of the stack. A conventional or known tamper drive 26 moves the tampers 22 and 24 into the approximate spacing for that dimension of the sheets to be accumulated in the compiler tray 12, so that the tampers 24, 25 can engage the opposing edges of those sheets to be tamped. Thereafter, the tamper drive 26 reciprocates the tampers by a short distance to provide the desired tamping action against the sheets, particularly the incoming top sheet, to provide square stacking, as extensively described in the above-cited and other edge tamping systems, which may be similar to or different from the disclosed system.

Meanwhile, an orthogonal (perpendicular thereto) edge of the same sheets is being registered by an edge registration system 30. This is the edge of the stack which is to be bound, in this case the inside or downstream end of the downward sloping compiler tray 12. The incoming sheets are driven into this binding edge registration here by a floppy belt system 35, which is driven and operated as described in the above-cited and other patents. This binding edge registration is provided here by two edge registration members 32 and 34, substantially spaced apart, and (as described) appropriately automatically repositioned for different sizes of sheets. These registration members 32 and 34 are preferably of a known U-shaped configuration with a slightly wider opening to acquire sheets therein. The bottom interior surfaces of these U-shaped registration members or channels 32 and 34 are a substantially vertical surface defining a binding edge registration line 39. Each of the members 32 and 34 here is separately mounted on a respective mounting arm 36 and 38. These L-shaped mounting arms 36 and 38 here are directly connected respectively to the tampers 22, 24 (or their connection to the drive system 26) at one end of the arms 36 and 38. The other end of the arms 36 and 38 mounts and supports, respectively, the registration members 32 and 34.

The compiling and fastening system 10 further includes a sheet set fastening system 40, provided here by a single stapler 42 mounted for linear movement slightly inside of and parallel to the binding edge registration line 39. This allows the stapler 42 to be positioned by a linear stapler drive 43 in any desired stapling position along one edge of the set of sheets.

The stapler 42 in its opened or unactuated position has a stapler jaw or throat opening 44. It may be seen that this jaw opening 44 is larger than the maximum exterior vertical dimension of the edge registration members 32 and 34. That is, the edge registration members 32, 34 here are small enough to actually pass through the throat or opening 44 of the stapler 42, and/or for the stapler to pass by these registration members 32 or 34, without any interference therebetween.

Figure 3:
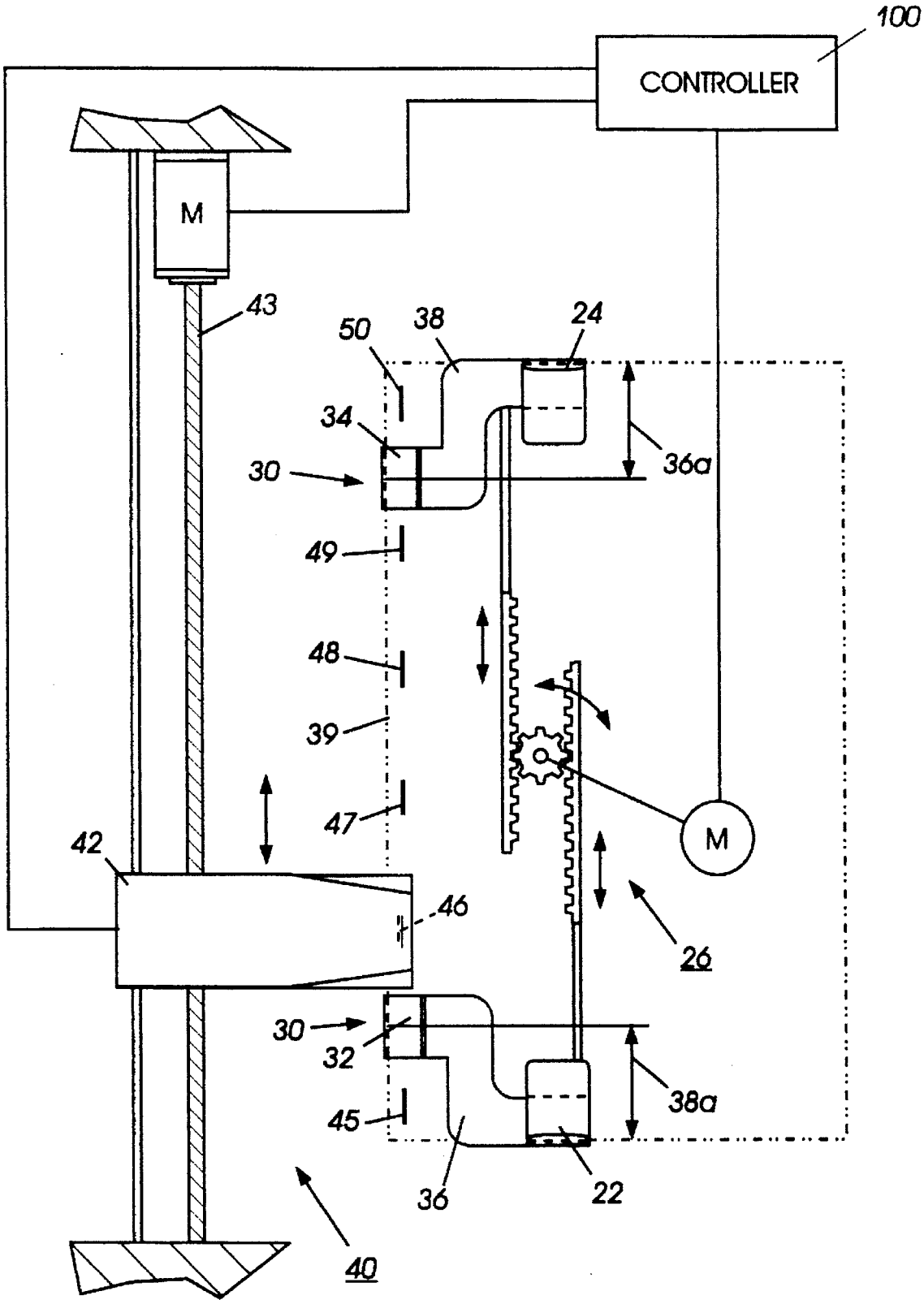
FIG. 3 is the same view as FIG. 2 but illustrating the stapler in another stapling position in which two staples are to be stapled along the binding edge of the copy set, and also showing for illustrative purposes all of the other possible staple positions in the print job set.
Figure 4:
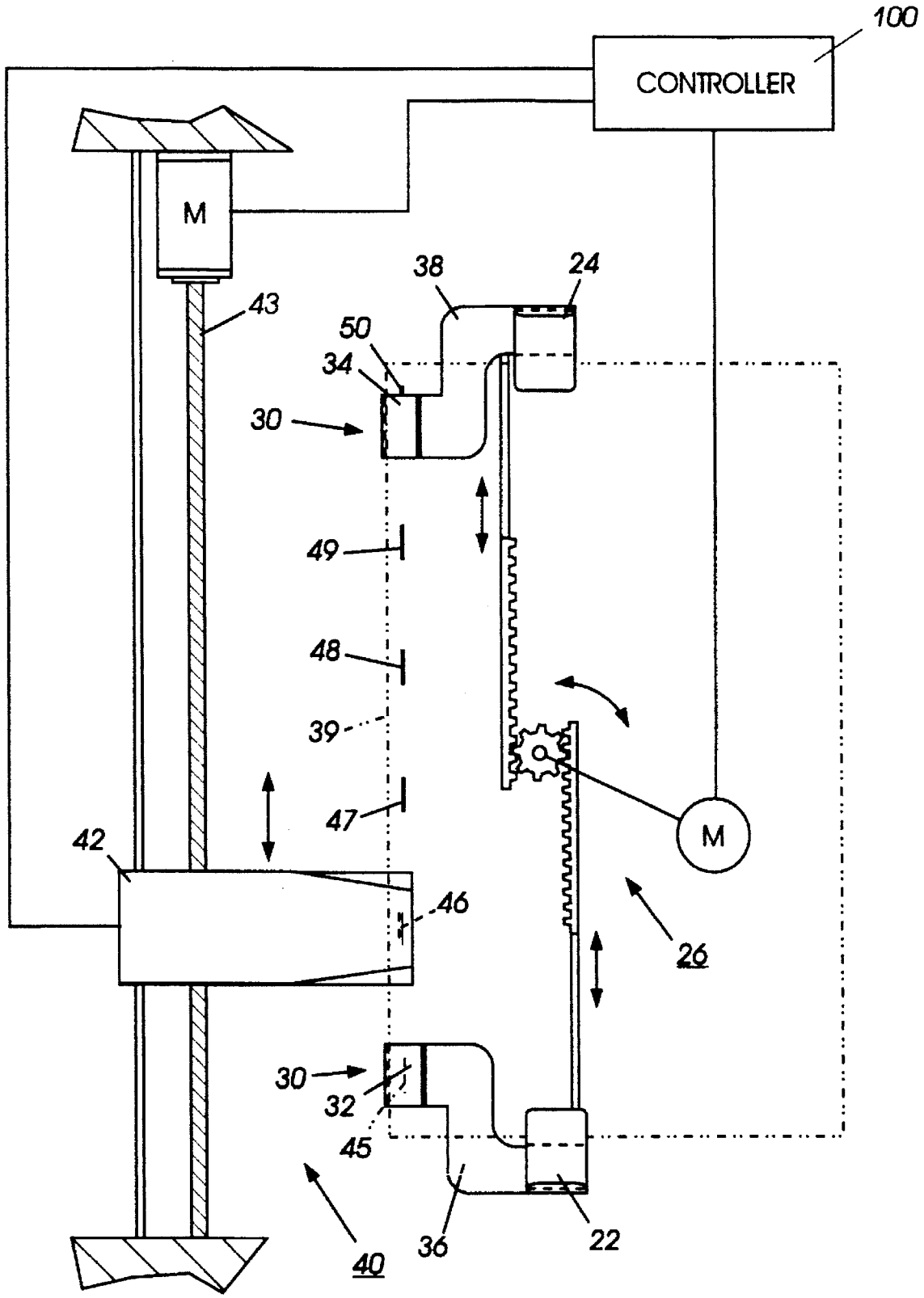
FIG. 4 is the same view as FIG. 3 but illustrating that the registration members can be moved out of the way of the stapler by movement of the tampers out away from the tamped edges of the stack.

Since the edge registration members 32, 34 here are only two in number, and are relatively narrow, the stapler 42 can staple unobstructively almost anywhere along the binding edge of the sheets 14. Furthermore, because of the connection of the registration members 32 and 34 to the edge tamper system 20, as described, the registration members automatically move to desired registration positions which are normally outside of the stapler jaw 44 for almost all stapling positions, as previously described. As also previously described, the tamper drive 43 can also be activated before stapling if a member 32 or 34 would otherwise be in a desired stapling position, to move the members 32 or 34 slightly, as shown in FIG. 4. Some of the optional stapling positions are illustrated in phantom in the top views of FIGS. 3 and 4. As shown there, optional stapling positions can be: a single corner staple (in either portrait or landscape mode) 45, two conventionally spaced edge staples 46, 47, or three conventionally spaced staples 48, 49, and 50.

As is conventionally practiced, the entire compiling and fastening system 10 may be controlled by a software programmable controller 100 which is connected to actuate and control the various sheet drives, the tamper drive 26, the stapler movement drive 43 and the solenoid or other drive of the stapler 42 which closes the stapler jaws and staples and clinches the staples in a known manner.

Although a stapler 42 is described herein, it will be appreciated that other edge binding or fastening systems, such as stitchers or a plastic riveter, may be employed, and likewise utilize the present system of automatic repositioning of the edge registration members by the edge tamper system, and also provide the ability of the edge registration members to pass through the finishing device from one side to the other for flexibility and compactness of the overall system.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In sheet compiling and fastening system, having a compiler in which a plurality of printed sheets may be stacked, a repositionable sheet set fastening system movable along a binding edge of said sheets to provide selectably variable sheet set fastening positions, and an edge tamper system extending orthogonally of said binding edge for tamping opposing lateral edges of the sheets being stacked orthogonally of said binding edge, wherein said edge tamper system is movable to adjust to different sheet dimensions of different sheets being stacked in said compiler; there are provided repositionable edge registration members connected to said edge tamper system to move with said edge tamper system independently of said sheet set fastening system along said binding edge of said sheets for registering within said edge registration members said binding edge of said plurality of sheets being stacked orthogonal of said tamped lateral edges along said binding registration edge, so that said movement of said edge tamper system to adjust to different sheet dimensions of different sheets being stacked in said compiler automatically repositions said edge registration members along said binding edge.

2. In a sheet compiling and fastening system, having a compiler in which a plurality of printed sheets may be stacked, an edge tamper system for tamping opposing lateral edges of the sheets being stacked, wherein said edge tamper system is movable to adjust to different sheet dimensions of different sheets being stacked in said compiler, there is provided repositionable edge registration members connected to move with said edge tamper system for registering an edge of said sheets orthogonal to said tamped lateral edges along a binding registration edge, and a movable sheet set fastening system which is movable generally parallel to said binding registration edge for selectably fastening said stacked sheets in spaced fastening positions;

wherein there are two said edge registration members, and said edge tamper system comprises two opposing edge tampers, and each said edge registration member is connected independently to one of said edge tampers but is laterally offset therefrom.

3. In a sheet compiling and fastening system, having a compiler in which a plurality of printed sheets may be stacked, an edge tamper system for tamping opposing lateral edges of the sheets being stacked, wherein said edge tamper system is movable to adjust to different sheet dimensions of different sheets being stacked in said compiler, there is provided repositionable edge registration members connected to move with said edge tamper system for registering an edge of said sheets orthogonal to said tamped lateral edges along a binding registration edge, and a movable sheet set fastening system which is movable generally, parallel to said binding registration edge for selectably fastening said stacked sheets in spaced fastening positions;

wherein said edge registration members are movable by said edge tamper system through said movable sheet set fastening system.

4. The sheet compiling and fastening system of claim 3, wherein said sheet set fastening system comprises a linerally movable stapler with an open jaw having a defined opening, and wherein said edge registration members have a dimension smaller than said defined open jaw opening or said stapler and are movable through said open jaw opening of said stapler by movement of said edge tamper system.

5. The sheet compiling and fastening system of claim 3, wherein there are two said edge registration members, which are generally U-shaped, and said edge tamper system comprises two opposing edge tampers, and each said edge registration member is connected independently to one of said edge tampers but is laterally offset therefrom.

6. The sheet compiling and fastening system of claim 3, wherein said sheet set fastening system comprises a linerally movable stapler with an open jaw having a defined opening, and wherein said edge registration members have a dimension smaller than said defined open jaw opening of said stapler and are movable through said open jaw opening of said stapler by movement of said edge tamper system, and wherein there are two said edge registration members, and said edge tamper system comprises two opposing edge tampers, and each said edge registration member is connected independently to one of said edge tampers but is laterally offset therefrom.

* * * * *